US011448153B2

(12) United States Patent
Katayama et al.

(10) Patent No.: US 11,448,153 B2
(45) Date of Patent: Sep. 20, 2022

(54) MISFIRE DETECTION DEVICE FOR INTERNAL COMBUSTION ENGINE, MISFIRE DETECTION METHOD FOR INTERNAL COMBUSTION ENGINE, AND MEMORY MEDIUM

(71) Applicant: TOYOTA JIDOSHA KABUSHIKI KAISHA, Aichi-ken (JP)

(72) Inventors: Akihiro Katayama, Toyota (JP); Takumi Anzawa, Okazaki (JP); Yuki Ikejiri, Nishio (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/523,917

(22) Filed: Nov. 11, 2021

(65) Prior Publication Data

US 2022/0154660 A1 May 19, 2022

(30) Foreign Application Priority Data

Nov. 17, 2020 (JP) ..... JP2020-190774

(51) Int. Cl.
*F02D 41/22* (2006.01)
*F02D 41/00* (2006.01)

(52) U.S. Cl.
CPC ..... *F02D 41/22* (2013.01); *F02D 41/009* (2013.01); *F02D 41/0087* (2013.01); *F02D 2200/024* (2013.01); *F02D 2200/101* (2013.01)

(58) Field of Classification Search
CPC .... F02D 41/22; F02D 41/0087; F02D 41/009; F02D 2200/101; F02D 2200/024
USPC ..... 123/435, 436, 481, 198 F; 701/111; 73/35.07, 35.12, 114.02, 114.04, 114.16, 73/114.17, 114.18
See application file for complete search history.

(56) References Cited

U.S. PATENT DOCUMENTS

2015/0192498 A1 7/2015 Takahashi

FOREIGN PATENT DOCUMENTS

JP 2015129483 A 7/2015

*Primary Examiner* — Hai H Huynh
(74) *Attorney, Agent, or Firm* — Hauptman Ham, LLP

(57) ABSTRACT

A misfire detection device and a misfire detection method for an internal combustion engine, and a memory medium are provided. Cylinders adjacent to the deactivated cylinder include a determined cylinder subject to a determination of whether a misfire has occurred and a cylinder different from the determined cylinder. It is determined that a misfire has occurred in the determined cylinder on condition that a divergence degree between a value of a combustion variable of the cylinder different from the determined cylinder and adjacent to the deactivated cylinder and a value of a combustion variable of the determined cylinder is greater than or equal to a specific amount. Combustion control has been executed in the cylinders adjacent to the deactivated cylinder and the cylinder different from the determined cylinder and adjacent to the deactivated cylinder.

8 Claims, 7 Drawing Sheets

10
12
12a
14
16
18
20
22
24
26
28
30
32
34
40
42
44
50
52
52a
54
54a
56
58
60
70
72
74
75
76
78
80
82
86
88
89
90
92
100
MS1
MS2
MS3
MS4
MS5
MS6
MS1~MS6
Ga
THW
Pc
Pex
Scr
Sm1
Sm2
MG
#1
#2
#3
#4
C
R
S
CPU
ROM
Memory Device
Peripheral Circuit
Controller
Warning Light

MISFIRE DETECTION DEVICE FOR INTERNAL COMBUSTION ENGINE, MISFIRE DETECTION METHOD FOR INTERNAL COMBUSTION ENGINE, AND MEMORY MEDIUM

RELATED APPLICATIONS

The present application claims priority of Japanese Application Number 2020-190774 filed on Nov. 17, 2020, the disclosure of which is hereby incorporated by reference herein in its entirety.

BACKGROUND

1. Field

The present disclosure relates to a misfire detection device for an internal combustion engine, a misfire detection method for an internal combustion engine, and a memory medium.

2. Description of Related Art

Japanese Laid-Open Patent Publication No. 2015-129483 discloses an example of a device that determines whether a misfire has occurred in a cylinder. The device determines whether a misfire has occurred from the difference in the rotation speed of a crankshaft in a small crank angle region between a determined cylinder and a cylinder of which the compression top dead center occurs immediately prior to the determined cylinder. The determined cylinder refers to a cylinder subject to the determination of whether a misfire has occurred. The rotation speed of the crankshaft in the small crank angle region strongly correlates with the combustion stroke of each cylinder of the internal combustion engine. When a misfire diagnostic value exceeds a reference determination threshold value, the device determines that a misfire is likely to have occurred in the determined cylinder. The misfire diagnostic value is calculated by subtracting, from the rotation angle difference related to the determined cylinder, the rotation angle difference related to a cylinder of which the compression top dead center occurs prior to the determined cylinder by 360°.

When determining that a misfire is likely to have occurred in the determined cylinder, the device determines that a misfire has occurred in a case where the misfire diagnostic value of the determined cylinder is extremely deviated from the misfire diagnostic values related to cylinders that are chronologically prior to and subsequent to the determined cylinder. The magnitude of the misfire diagnostic value of the determined cylinder is compared with the magnitude of the misfire diagnostic values of the cylinders that are chronologically prior to and subsequent to the determined cylinder in order to prevent an erroneous misfire determination caused by the influence of the rotation behavior of the crankshaft resulting from, for example, a disturbance from a road surface.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects of the present disclosure will now be described.

Aspect 1: An aspect of the present disclosure provides a misfire detection device for an internal combustion engine. The misfire detection device is employed in the internal combustion engine including cylinders. The misfire detection device is configured to execute a deactivating process, a combustion variable obtaining process, and a determining process. The deactivating process deactivates combustion control for air-fuel mixture in a deactivated cylinder serving as a specified one of the cylinders. The combustion variable obtaining process obtains a value of a combustion variable. The combustion variable indicates a combustion state in each of the cylinders. A sensor detects a physical quantity corresponding to the combustion state of the air-fuel mixture in each of the cylinders. The combustion variable is defined by a detection value of the sensor. The determining process determines whether a misfire has occurred in a determined cylinder serving as a cylinder subject to a determination of whether the misfire has occurred on condition that a divergence degree is greater than or equal to a specific amount during the execution of the deactivating process. An occurrence point in time of each of compression top dead centers of cylinders adjacent to the deactivated cylinder is adjacent to an occurrence point in time of a compression top dead center of the deactivated cylinder. The cylinders adjacent to the deactivated cylinder include the determined cylinder and a cylinder different from the determined cylinder and adjacent to the deactivated cylinder. The divergence degree is between the value of the combustion variable of the cylinder different from the determined cylinder and adjacent to the deactivated cylinder and the value of the combustion variable of the determined cylinder. The cylinders adjacent to the deactivated cylinder and the cylinder different from the determined cylinder and adjacent to the deactivated cylinder are cylinders in which the combustion control has been executed.

In this configuration, the value of the combustion variable of the deactivated cylinder subject to the deactivating process is equivalent to the value of the combustion variable obtained during a misfire. The occurrence point in time of the compression top dead center of a cylinder adjacent to the determined cylinder is adjacent to the occurrence point in time of the compression top dead center of the determined cylinder. It is assumed that the cylinder adjacent to the determined cylinder is used as the deactivated cylinder. In this case, although a misfire has occurred in the determined cylinder, the divergence degree between the value of the combustion variable related to the determined cylinder and the value of the combustion variable related to the cylinder adjacent to the determined cylinder (in this case, related to the deactivated cylinder) may not be greater than a specific amount. Therefore, in the above-described configuration, in such a case where the cylinder adjacent to the determined cylinder is used as the deactivated cylinder, the value of the combustion variable of the cylinder different from the determined cylinder and adjacent to the deactivated cylinder is used. The cylinder different from the determined cylinder and adjacent to the deactivated cylinder includes the occurrence interval of the compression top dead center adjacent to the occurrence interval of the compression top dead center of the deactivated cylinder, but is different from the determined cylinder and adjacent to the deactivated cylinder. The misfire detection device determines whether a misfire has occurred in the determined cylinder in reference to the divergence degree between the value of the combustion variable of the cylinder different from the determined cylinder and adjacent to the deactivated cylinder and the value of the combustion variable related to the determined cylinder. Thus, in the misfire determining process, an erroneous determination is prevented from being executed due to the deactivating process.

The inventors examined supplying unburned fuel and oxygen into exhaust gas by deactivating combustion control only in a specified cylinder and increasing the air-fuel ratio of the remaining cylinders to be richer than the stoichiometric air-fuel ratio in order to execute a regenerating process for an exhaust gas aftertreatment device when the shaft torque of the internal combustion engine is not zero. However, in this case, when cylinders in which combustion control is deactivated are included chronologically prior to and subsequent to a cylinder in which the misfire is determined as being likely to have occurred, an erroneous determination may be made in the misfire determining process that is based on the fact that its misfire diagnostic value is extremely deviated from the misfire diagnostic values of the cylinders that are chronologically prior to and subsequent to that cylinder. The above-described configuration avoids such an erroneous determination.

Aspect 2: In the misfire detection device for the internal combustion engine according to Aspect 1, the sensor includes a crank angle sensor. The combustion variable is a rotation fluctuation amount of a crankshaft of the internal combustion engine. The rotation fluctuation amount relates to a difference between magnitudes of instantaneous speed variables. Each of the instantaneous speed variables indicates a rotation speed of the crankshaft in a specific angle interval that is less than or equal to an occurrence interval of a compression top dead center of the internal combustion engine. The instantaneous speed variables of the rotation fluctuation amount of a certain cylinder of the cylinders include the instantaneous speed variable in a period between a compression top dead center of the certain cylinder and a compression top dead center subsequent to the compression top dead center of the certain cylinder.

The rotation behavior of the crankshaft in the period between the compression top dead center of the certain cylinder and its subsequent compression top dead center strongly correlates with whether a misfire has occurred in the certain cylinder. Alternatively, the rotation behavior of the crankshaft in the period between the compression top dead center of the certain cylinder and its subsequent compression top dead center is beneficial for characterizing whether a misfire has occurred in the certain cylinder. Thus, the above-described configuration quantifies the rotation fluctuation amount of the certain cylinder using the instantaneous speed variable related to the period between the compression top dead center of the certain cylinder and its subsequent compression top dead center. This allows the rotation fluctuation amount to indicate with high accuracy whether a misfire has occurred in the certain cylinder.

Aspect 3: In the misfire detection device according to Aspect 2, the determining process includes a process that determines whether the misfire has occurred by comparing a magnitude of a determination threshold value with a magnitude of a ratio of the rotation fluctuation amount of the cylinder different from the determined cylinder and adjacent to the deactivated cylinder to the rotation fluctuation amount of the determined cylinder.

The magnitude of the rotation fluctuation amount varies in correspondence with the rotation speed of the internal combustion engine and the load on the internal combustion engine. Thus, the magnitude of a suitable determination threshold value greatly fluctuates in correspondence with the rotation speed and the load when the divergence degree is defined in reference to the difference between the rotation fluctuation amount of the determined cylinder and the rotation speed of the cylinder different from the determined cylinder and adjacent to the deactivated cylinder. As compared with the magnitude of the rotation fluctuation amount, the pair of rotation fluctuation amounts varies to a small extent in correspondence with the rotation speed and the load. Thus, for example, as compared with the use of the difference, the use of the ratio limits the fluctuation of the magnitude of a suitable determination threshold value in correspondence with the rotation speed and the load.

Aspect 4: In the misfire detection device according to Aspect 2 or 3, the deactivated cylinder is one cylinder. The determining process includes a process that determines whether the misfire has occurred in the determined cylinder on condition that a divergence degree between the rotation fluctuation amount of the cylinder different from the determined cylinder and adjacent to the deactivated cylinder and the rotation fluctuation amount of the determined cylinder is greater than or equal to a specific amount and on the following condition. That is, a divergence degree between the rotation fluctuation amount of a closer cylinder and the rotation fluctuation amount of the determined cylinder is greater than or equal to a specific amount. An occurrence point in time of a compression top dead center of the closer cylinder is closer to an occurrence point in time of the compression top dead center of the determined cylinder than an interval between an occurrence point in time of a compression top dead center of the cylinder different from the determined cylinder and adjacent to the deactivated cylinder and the occurrence point in time of the compression top dead center of the determined cylinder. The closer cylinder is a cylinder in which the combustion control is executed.

In the above-described configuration, the divergence degree from the rotation fluctuation amount of the determined cylinder is determined in both the cylinders of which the compression top dead centers are advanced and retarded with respect to the determined cylinder. Thus, for example, as compared with when the divergence degree from the rotation fluctuation amount of the determined cylinder is determined in only one of the cylinders advanced and retarded with respect to the determined cylinder, the accuracy of the determination of whether a misfire has occurred is further increased.

Aspect 5: In the misfire detection device according to Aspect 1, the sensor is provided in a combustion chamber of each of the cylinders. Further, the sensor detects the combustion state of the air-fuel mixture in the combustion chamber. The combustion variable of each of the cylinders is quantified using the detection value of the sensor during a compression top dead center of the cylinder and a compression top dead center that occurs subsequently.

The combustion stroke of the certain cylinder is approximately a period from the compression top dead center of the certain cylinder to its subsequent compression top dead center. Thus, the combustion state in the combustion stroke is quantified using the detection value of the sensor in that period. Accordingly, the above-described configuration allows the combustion variable to indicate with high accuracy whether a misfire has occurred in the certain cylinder.

Aspect 6: In the misfire detection device according to Aspect 5, the sensor detects pressure in the combustion chamber.

The pressure in the combustion chamber increases to a larger extent when the air-fuel mixture is burned in the combustion stroke than when, for example, the air-fuel mixture is not burned. Thus, the pressure in the combustion chamber is a suitable variable indicating the combustion state of the air-fuel mixture in the combustion chamber. Accordingly, the above-described configuration quantifies the combustion variable using the pressure in the combustion chamber. This allows the combustion variable to indicate with high accuracy whether a misfire has occurred in the certain cylinder.

Aspect 7: A misfire detection method for an internal combustion engine that executes various processes according to any one of the above-described aspects is provided.

Aspect 8: A non-transitory computer-readable memory medium that stores a program causing a processor to execute the various processes according to any one of the above-described aspects is provided.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A first embodiment will now be described with reference to FIGS. 1 to 6.

Figure 1:
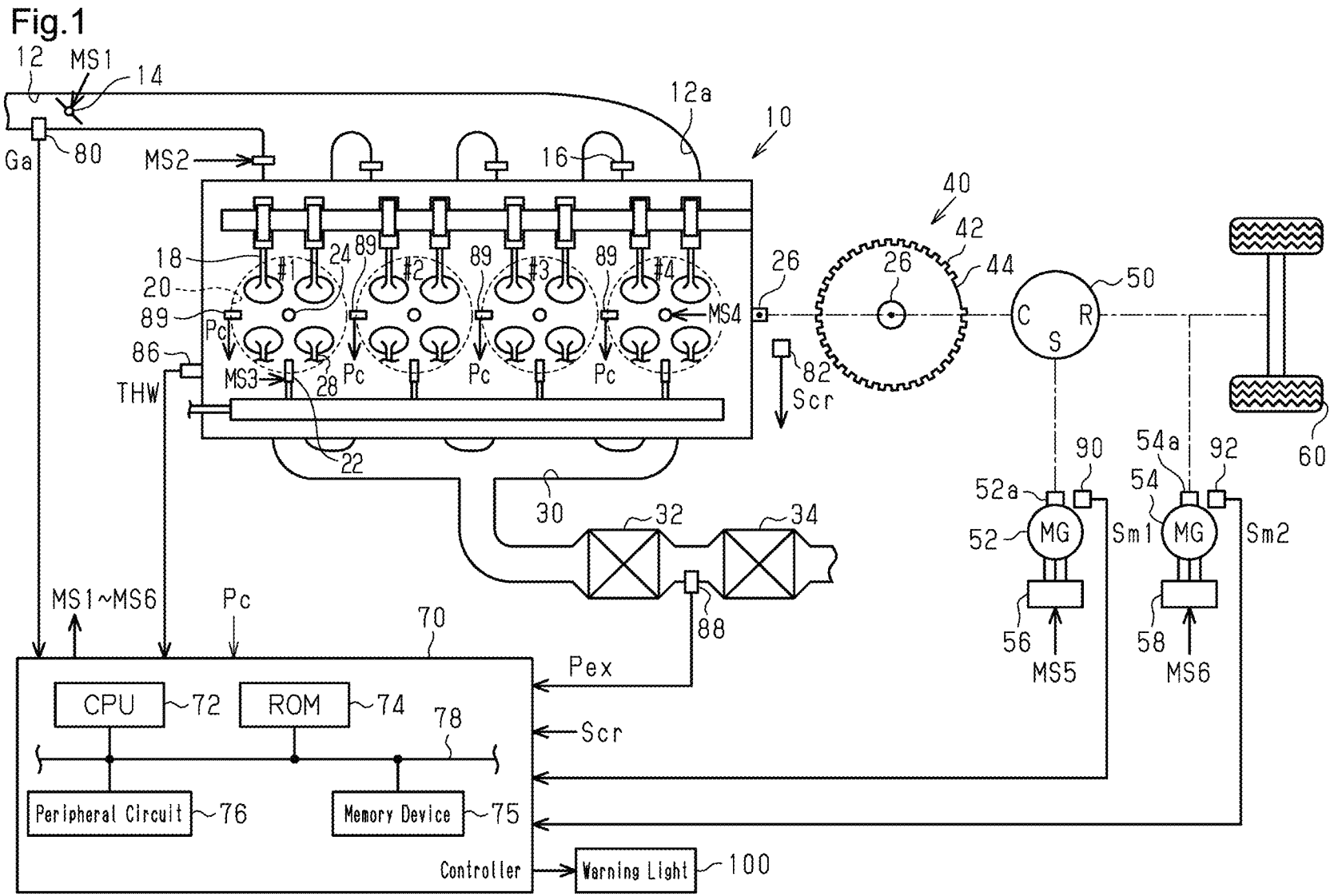
FIG. 1 is a diagram showing the configuration of a driving system and a controller according to a first embodiment.

As shown in FIG. 1, an internal combustion engine 10 includes four cylinders #1 to #4. The internal combustion engine 10 includes an intake passage 12 provided with a throttle valve 14. An intake port 12*a* at a downstream portion of the intake passage 12 includes port injection valves 16. Each of the port injection valves 16 injects fuel into the intake port 12*a*. The air drawn into the intake passage 12 and the fuel injected from the port injection valves 16 flow into combustion chambers 20 as intake valves 18 open. Fuel is injected into the combustion chambers 20 from direct injection valves 22. The air-fuel mixtures of air and fuel in the combustion chambers 20 are burned by spark discharge of ignition plugs 24. The generated combustion energy is converted into rotation energy of a crankshaft 26.

When exhaust valves 28 open, the air-fuel mixtures burned in the combustion chambers 20 are discharged to an exhaust passage 30 as exhaust gas. The exhaust passage 30 includes a three-way catalyst 32 having an oxygen storage capacity and a gasoline particulate filter (GPF) 34. In the GPF 34 of the present embodiment, it is assumed that a three-way catalyst is supported by a filter that traps particulate matter (PM).

A crank rotor 40 with teeth 42 is coupled to the crankshaft 26. The teeth 42 each indicate a rotation angle of the crankshaft 26. While the crank rotor 40 basically includes each tooth 42 at an interval of 10° CA, the crank rotor 40 includes an untoothed portion 44. In the untoothed portion 44, the interval between adjacent ones of the teeth 42 is 30° CA. The untoothed portion 44 indicates the reference rotation angle of the crankshaft 26. CA stands for crank angle.

The crankshaft 26 is mechanically coupled to a carrier C of a planetary gear mechanism 50, which includes a power split device. A rotary shaft 52*a* of a first motor generator 52 is mechanically coupled to a sun gear S of the planetary gear mechanism 50. Further, a rotary shaft 54*a* of a second motor generator 54 and driven wheels 60 are mechanically coupled to a ring gear R of the planetary gear mechanism 50. An inverter 56 applies alternating-current voltage to a terminal of the first motor generator 52. An inverter 58 applies alternating-current voltage to a terminal of the second motor generator 54.

The internal combustion engine 10 is controlled by a controller 70. In order to control the controlled variables of the internal combustion engine 10 (for example, torque or exhaust component ratio), the controller 70 operates operation units of the internal combustion engine 10 such as the throttle valve 14, the port injection valves 16, the direct injection valves 22, and the ignition plug 24. The controller 70 controls the first motor generator 52, and operates the inverter 56 in order to control a rotation speed serving as a controlled variable of the first motor generator 52. The controller 70 controls the second motor generator 54, and operates the inverter 58 in order to control torque serving as a controlled variable of the second motor generator 54. FIG. 1 shows operation signals MS1 to MS6 that correspond to the throttle valve 14, the port injection valves 16, the direct injection valves 22, the ignition plugs 24, the inverter 56, and the inverter 58, respectively. In order to control the controlled variables of the internal combustion engine 10, the controller 70 refers to an intake air amount Ga detected by an air flow meter 80, an output signal Scr of a crank angle sensor 82, a water temperature THW detected by a water temperature sensor 86, a pressure Pex of exhaust gas flowing into the GPF 34. The pressure Pex is detected by an exhaust pressure sensor 88. Further, the controller 70 refers to an in-cylinder pressure Pc detected by an in-cylinder pressure sensor 89. The in-cylinder pressure sensor 89 is arranged in each of the combustion chambers 20 of cylinders #1 to #4. Additionally, in order to control the controlled variables of the first motor generator 52 and the second motor generator 54, the controller 70 refers to an output signal Sm1 of a first rotation angle sensor 90 and an output signal Sm2 of a second rotation angle sensor 92. The output signal Sm1 is used to detect the rotation angle of the first motor generator 52. The output signal Sm2 is used to detect the rotation angle of the second motor generator 54.

The controller 70 includes a CPU 72, a ROM 74, a memory device 75, and peripheral circuitry 76. These components are capable of communicating with one another via a communication line 78. The peripheral circuitry 76 includes a circuit that generates a clock signal regulating internal operations, a power supply circuit, and a reset circuit. The controller 70 controls the controlled variables by causing the CPU 72 to execute programs stored in the ROM 74.

Figure 2:
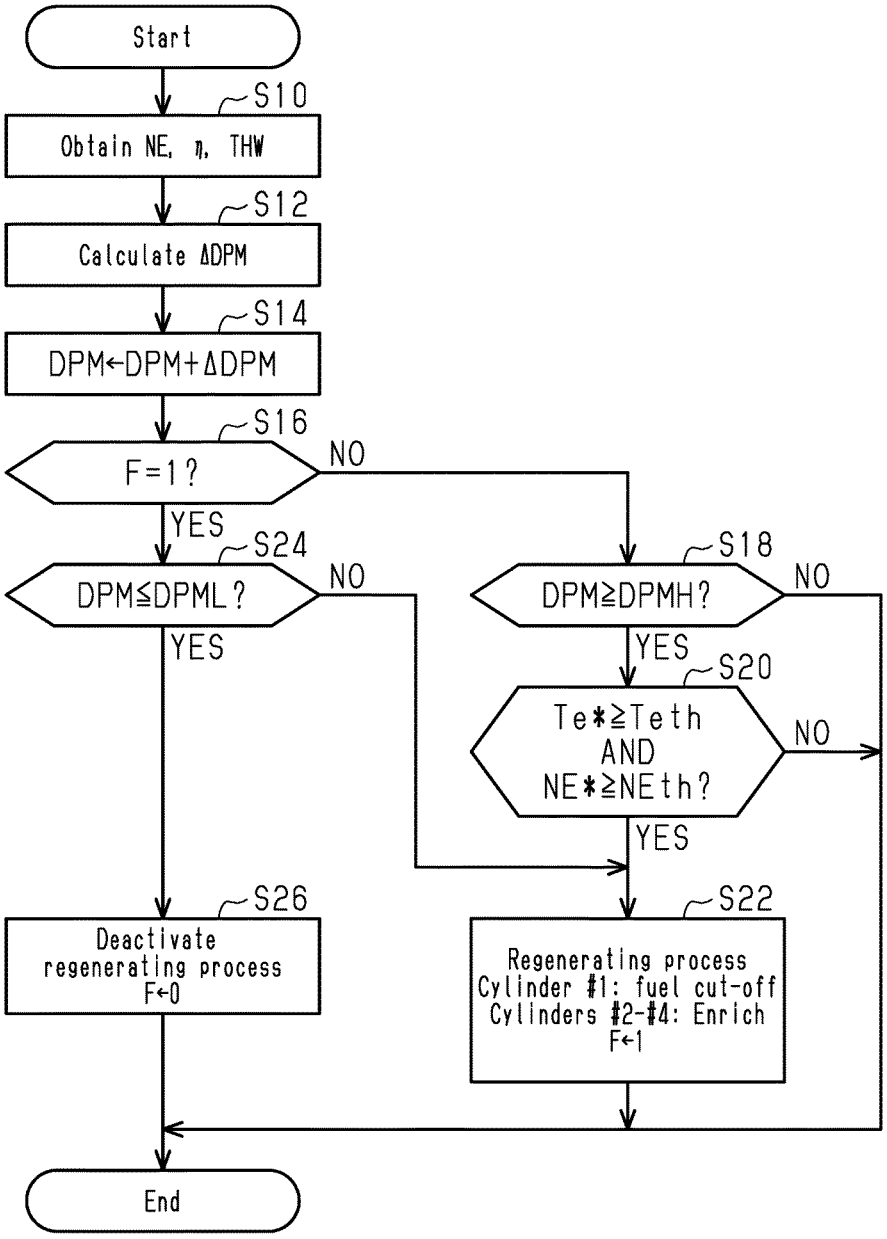
FIG. 2 is a flowchart illustrating a procedure for processes executed by the controller in the embodiment of FIG. 1.

FIG. 2 shows a procedure for processes executed by the controller 70 of the present embodiment. The processes shown in FIG. 2 are executed by the CPU 72 repeatedly executing programs stored in the ROM 74, for example, in a specific cycle. In the following description, the number of each step is represented by the letter S followed by a numeral.

In the series of processes shown in FIG. 2, the CPU 72 first obtains the engine speed NE, the charging efficiency η, and the water temperature THW (S10). The rotation speed NE is calculated by the CPU 72 in reference to the output signal Scr. The charging efficiency η is calculated by the CPU 72 in reference to the intake air amount Ga and the rotation speed NE. Next, the CPU 72 uses the rotation speed NE, the charging efficiency η, and the water temperature THW to calculate an update amount ΔDPM of a deposition amount DPM (S12). The deposition amount DPM is the amount of PM trapped by the GPF 34. More specifically, the CPU 72 uses the rotation speed NE, the charging efficiency η, and the water temperature THW to calculate the amount of PM in the exhaust gas discharged to the exhaust passage 30. Further, the CPU 72 uses the rotation speed NE and the charging efficiency η to calculate the temperature of the GPF 34. The CPU 72 uses the amount of PM in exhaust gas and the temperature of the GPF 34 to calculate the update amount ΔDPM.

Then, the CPU 72 updates the deposition amount DPM in correspondence with the deposition amount DPM (S14). Subsequently, the CPU 72 determines whether a flag F is 1 (S16). When the flag F is 1, the flag F indicates that the regenerating process is being executed to burn and remove the PM in the GPF 34. When the flag F is 0, the flag F indicates that the regenerating process is not being executed. When determining that the flag F is 0 (S16: NO), the CPU 72 determines whether the deposition amount DPM is greater than or equal to a regeneration execution value DPMH (S18). The regeneration execution value DPMH is set to a value in which PM needs to be removed because the amount of PM trapped by the GPF 34 is large. When determining that the deposition amount DPM is greater than or equal to the regeneration execution value DPMH (S18: YES), the CPU 72 determines whether the logical conjunction of the following conditions (a) and (b) is true (S20). The process of S20 determines whether the execution of the regenerating process of the GPF 34 is permitted.

Condition (a): An engine requested torque Te* for the internal combustion engine is greater than or equal to a given value Teth.

Condition (b): The rotation speed NE is greater than or equal to a given speed NEth.

When determining that the logical conjunction of the following conditions (a) and (b) is true (S20: YES), the CPU 72 executes the regenerating process and substitutes 1 to the flag F (S22). In other words, the CPU 72 deactivates the injection of fuel from the port injection valve 16 and the direct injection valve 22 of cylinder #1 and makes the air-fuel ratio of air-fuel mixture in the combustion chambers 20 of cylinders #2 to #4 richer than the stoichiometric air-fuel ratio. The process of S22 causes oxygen and unburned fuel to be discharged to the exhaust passage 30 so as to increase the temperature of the GPF 34, thereby burning and removing the PM trapped by the GPF 34. That is, this process causes oxygen and unburned fuel to be discharged to the exhaust passage 30 so as to burn the unburned fuel and thus increase the temperature of exhaust gas in the three-way catalyst 32 or the like, thereby increasing the temperature of the GPF 34. Additionally, the supplying of oxygen into the GPF 34 allows the PM trapped by the GPF 34 to be burned and removed.

When determining that the flag F is 1 (S16: YES), the CPU 72 determines whether the deposition amount DPM is less than or equal to a deactivation threshold value DPML (S24). The deactivation threshold value DPML is set to a value in which the regenerating process is allowed to be deactivated because the amount of PM trapped by the GPF 34 is sufficiently small. When determining that the deposition amount DPM is greater than the deactivation threshold value DPML (S24: NO), the CPU 72 proceeds to the process of S22. When determining that the deposition amount DPM is less than or equal to the deactivation threshold value DPML (S24: YES), the CPU 72 deactivates the regenerating process and substitutes 0 into the flag F (S26).

When completing the process of S22, S26 or when making a negative determination in the process of S18, S20, the CPU 72 temporarily ends the series of processes shown in FIG. 2.

Figure 3:
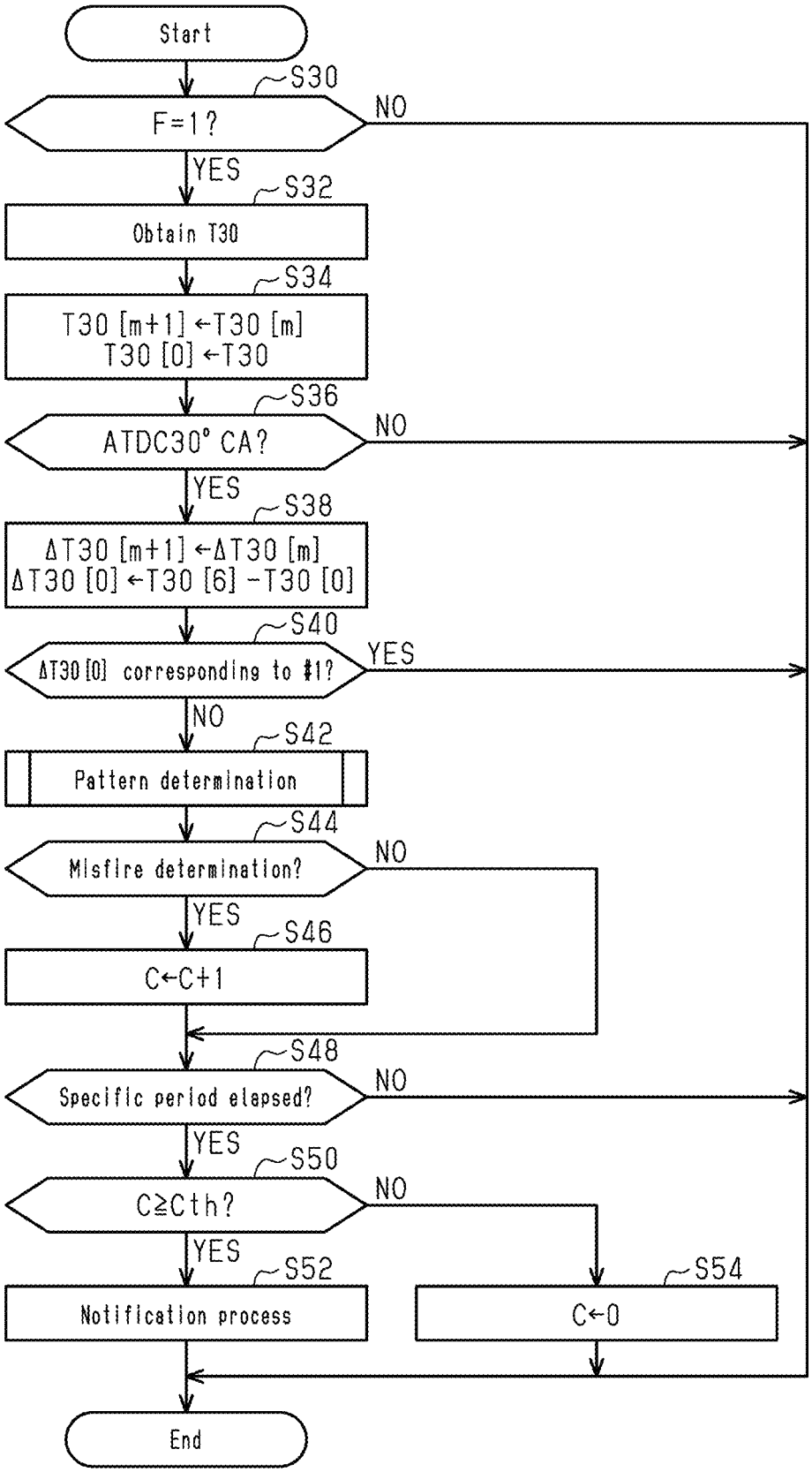
FIG. 3 is a flowchart illustrating a procedure for processes executed by the controller in the embodiment of FIG. 1.

FIG. 3 illustrates a procedure for other processes executed by the controller 70. The processes shown in FIG. 3 are executed by the CPU 72 repeatedly executing programs stored in the ROM 74, for example, in a specific cycle.

In the series of processes shown in FIG. 3, the CPU 72 first determines whether the flag F is 1 (S30). When determining that the flag F is 1 (S30: YES), the CPU 72 obtains a time T30 for the crankshaft 26 to rotate by 30° CA (S32). The CPU 72 uses the output signal Scr to calculate the time T30 by counting the time for the tooth 42 detected by the crank angle sensor 82 to be switched to the tooth 42 separated from that tooth 42 by 30° CA. Next, the CPU 72 substitutes the time T30[*m*] into the time T30[*m*+1], where m=0, 1, 2, 3, . . . , and substitutes, into the time T30[0], the time T30 that was newly obtained in the process of S32 (S34). The process of S34 is performed such that the variable in the square bracket subsequent to the time T30 becomes larger the further back in time it represents. In a case where the value of the variable in the square bracket is increased by one through the process of S34, the time T30 is counted at the previous 30° CA.

Subsequently, the CPU 72 determines whether the current rotation angle of the crankshaft 26 is ATDC30° CA with reference to the compression top dead center of one of cylinders #1 to #4 (S36). ATDC stands for after top dead center. When determining that the current rotation angle of the crankshaft 26 is ATDC30° CA (S36: YES), the CPU 72 substitutes the rotation fluctuation amount ΔT30[*m*] into the rotation fluctuation amount ΔT30[*m*+1] and substitutes, into the rotation fluctuation amount ΔT30[0], a value obtained by subtracting the time T30[0] from the time T30[6] (S38). The rotation fluctuation amount ΔT30 is a variable that is approximately zero or a large positive value when no misfire occurs in a determined cylinder and is a negative value when a misfire occurs in the determined cylinder. The determined cylinder refers to a cylinder subject to the determination of whether a misfire has occurred. The compression top dead center of the determined cylinder occurs prior to, by 180° CA, the cylinder determined as having passed by the compression top dead center by 30° through the process of S36. When the cylinder preceded by 180° CA is cylinder #1, the cylinder preceded by 180° CA is excluded from the determined cylinder. That is, cylinder #1 in which fuel injection is deactivated by the deactivating process is not used as the determined cylinder.

Next, the CPU 72 determines whether the rotation fluctuation amount ΔT30[0] calculated by the process of S38 is the rotation fluctuation amount ΔT30 of cylinder #1 (S40). That is, the CPU 72 determines whether the compression top dead center of cylinder #1 has occurred prior to, by 210° CA, the point in time at which an affirmative determination was made in the process of S36. When determining that the rotation fluctuation amount ΔT30[0] is not the rotation fluctuation amount ΔT30 of cylinder #1 (S40: NO), the CPU 72 executes a pattern determination for a misfire (S42). The CPU 72 determines whether a misfire determination has been made as a result of the pattern determination (S44). When determining that the misfire determination has been made (S44: YES), the CPU 72 increments a counter C (S46). When completing the process of S46 or making a negative determination in the process of S44, the CPU 72 determines whether a specific period has elapsed from the later one of the point in time at which the process of S44 was executed for the first time and the latest point in time at which the process of S54 (described later) was executed (S48). When determining that the specific period has elapsed (S48: YES), the CPU 72 determines whether the counter C is greater than or equal to a threshold value Cth (S50). The threshold value Cth is set in correspondence with the number of occurrences of a misfire in the specific period when a misfire occurs at a significant frequency. When determining that the counter C is greater than or equal to the threshold value Cth (S50: YES), the CPU 72 executes a notification process that notifies the user that misfires occur at the significant frequency (S52). More specifically, the CPU 72 executes the notification process to operate a warning light 100, which is shown in FIG. 1, so as to indicate that misfires occur at the significant frequency.

When determining that the counter C is less than the threshold value Cth (S50: NO), the CPU 72 initializes the counter C (S54).

When completing the process of S52, S54, when making a negative determination in the process of S30, S36, S48, or when making an affirmative determination in the process of S40, the CPU 72 temporarily ends the series of processes shown in FIG. 3.

The process of S42 determines whether a misfire has occurred in the determined cylinder from a divergence degree between the rotation fluctuation amounts ΔT30 of cylinders that are chronologically prior to and subsequent to the determined cylinder and the rotation fluctuation amount ΔT30 of the determined cylinder. More specifically, the occurrence interval between the compression top dead centers of the cylinders that are chronologically prior to and subsequent to the determined cylinder is chronologically prior to and subsequent to the compression top dead center of the determined cylinder. In the present embodiment, when the flag F is 0, the rotation fluctuation amount of the determined cylinder is a rotation fluctuation amount ΔT30[1]. The rotation fluctuation amounts of the cylinders that are chronologically prior to and subsequent to the determined cylinder are the rotation fluctuation amount ΔT30[0] and a rotation fluctuation amount ΔT30[2]. That is, in the process of S42, it is assumed that the when the flag F is 0, the process that determines whether a misfire has occurred is executed in reference to the divergence degree of the rotation fluctuation amount ΔT30[1], which is subject to the determination, from the rotation fluctuation amount ΔT30[0] and the divergence degree of the rotation fluctuation amount ΔT30[1] from the rotation fluctuation amount ΔT30[2] (refer to section (a) of FIG. 6). When the flag F is 1, the rotation fluctuation amount ΔT30[0] may become the rotation fluctuation amount ΔT30 of cylinder #1. Alternatively, the rotation fluctuation amount ΔT30[2] may become the rotation fluctuation amount ΔT30 of cylinder #1 (refer to section (b) of FIG. 6). Thus, the following process is executed.

Figure 4:
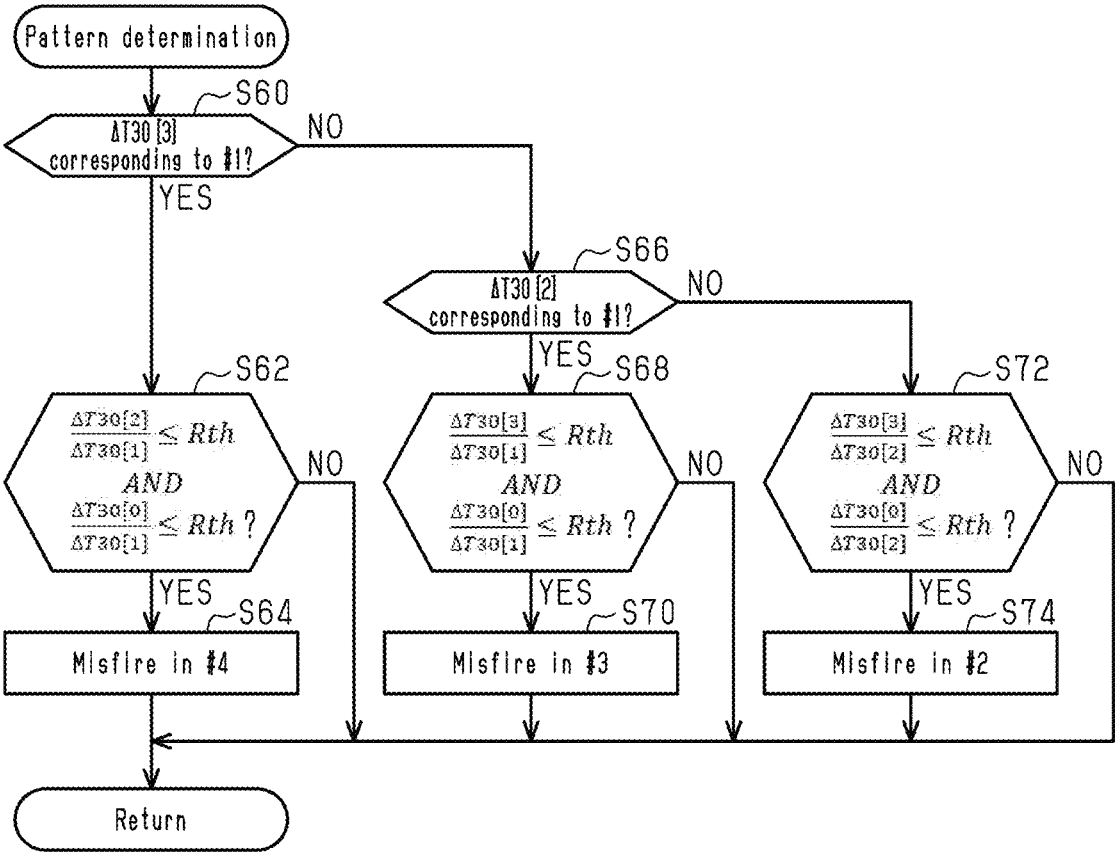
FIG. 4 is a flowchart illustrating a procedure for processes executed by the controller in the embodiment of FIG. 1.

FIG. 4 shows the details of the process of S42.

Figure 5:
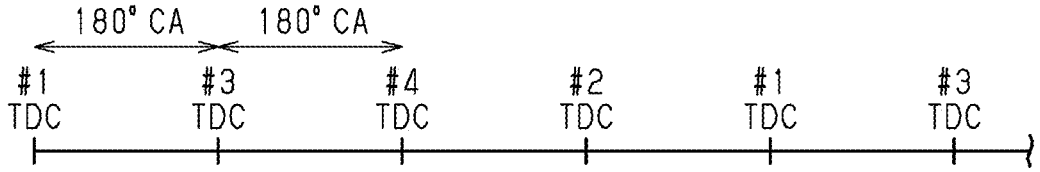
FIG. 5 is a timing diagram showing the occurrence order of the compression top dead center according to the first embodiment.

As shown in FIG. 4, the CPU 72 first determines whether a rotation fluctuation amount ΔT30[3] relates to cylinder #1 (S60). This process determines whether the pattern determination can be executed in the same manner as when the flag F is 0. That is, in the present embodiment, as shown in FIG. 5, the compression top dead center occurs in the order of cylinders #1, #3, #4, and #2. Thus, when the rotation fluctuation amount ΔT30[3] relates to cylinder #1, the rotation fluctuation amounts ΔT30[0] to ΔT30[2] relate to cylinders in which combustion control is continued.

When determining that the rotation fluctuation amount ΔT30[3] relates to cylinder #1 (S60: YES), the CPU 72 determines whether the logical conjunction of the following conditions (A) and (B) is true (S62).

Condition (A): The value obtained by dividing the rotation fluctuation amount ΔT30[2] by the rotation fluctuation amount ΔT30[1] is less than or equal to a determination value Rth.

Condition (B): The value obtained by dividing the rotation fluctuation amount ΔT30[0] by the rotation fluctuation amount ΔT30[1] is less than or equal to the determination value Rth.

This process of 862 is executed to determine whether the rotation fluctuation amount ΔT30[1] of cylinder #4 is extremely smaller than the rotation fluctuation amounts ΔT30[0] and ΔT30[2] that are chronologically prior to and subsequent to the rotation fluctuation amount ΔT30[1].

Figure 6:
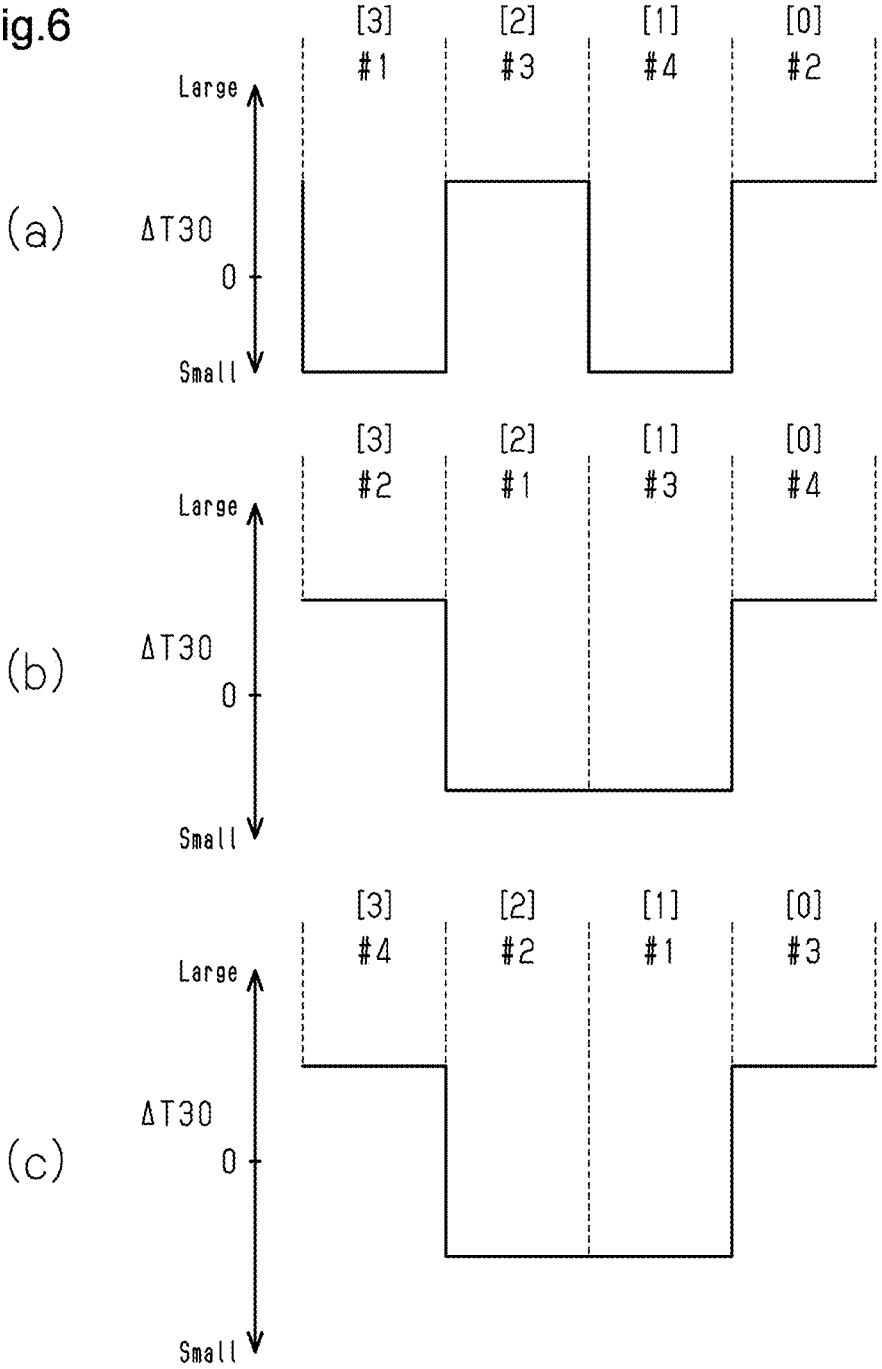
FIG. 6 is a timing diagram including sections (a) to (c), each showing the pattern determination.

Section (a) of FIG. 6 shows changes in the rotation fluctuation amount ΔT30 in a case where a misfire has occurred in cylinder #4. As shown in section (a) of FIG. 6, the rotation fluctuation amount ΔT30[3] of cylinder #1 in which combustion control is intentionally deactivated and the rotation fluctuation amount ΔT30[1] of cylinder #4 in which a misfire has occurred are negative. In contrast, the rotation fluctuation amounts ΔT30[2] and ΔT30[0] of cylinders #3 and #2 in which combustion control is continued and a misfire has not occurred are positive. Thus, in the example shown in section (a) of FIG. 6, the conditions (A) and (B) are both satisfied.

Referring back to FIG. 4, when determining that the logical conjunction of S62 is true (S62: YES), the CPU 72 determines that a misfire has occurred in cylinder #4 (S64).

When making a negative determination in the process of S60, the CPU 72 determines whether the rotation fluctuation amount ΔT30[2] relates to cylinder #1 (S66). This process is executed to determine whether it is appropriate to use the above-described condition (A) for a determination of whether an anomaly has occurred. When determining that the rotation fluctuation amount ΔT30[2] relates to cylinder #1 (S66: YES), the CPU 72 determines whether the logical conjunction of the following condition (C) and the above-described condition (B) is true (S68).

Condition (C): The value obtained by dividing the rotation fluctuation amount ΔT30[3] by the rotation fluctuation amount ΔT30[1] is less than or equal to the determination value Rth.

This process of S68 is executed to determine whether the rotation fluctuation amount ΔT30[1] of cylinder #3 is extremely larger than the rotation fluctuation amounts ΔT30[0] and ΔT30[3] that are chronologically prior to and subsequent to the rotation fluctuation amount ΔT30[1] in the cylinders in which combustion control is executed.

Section (b) of FIG. 6 shows changes in the rotation fluctuation amount ΔT30 in a case where a misfire has occurred in cylinder #3. As shown in section (b) of FIG. 6, the rotation fluctuation amount ΔT30[2] of cylinder #1 in which combustion control is intentionally deactivated and the rotation fluctuation amount ΔT30[1] of cylinder #3 in which a misfire has occurred are negative. In contrast, the rotation fluctuation amounts ΔT30[3] and ΔT30[0] of cylinders #2 and #4 in which combustion control is continued and a misfire has not occurred are positive. Thus, in the example shown in section (b) of FIG. 6, the conditions (C) and (B) are both satisfied.

Referring back to FIG. 4, when determining that the logical conjunction of S68 is true (S68: YES), the CPU 72 determines that a misfire has occurred in cylinder #3 (S70).

When determining that the rotation fluctuation amount ΔT30[1] relates to cylinder #1 (S66: NO), the CPU 72 determines whether the logical conjunction of the following conditions (D) and (E) is true (S72).

Condition (D): The value obtained by dividing the rotation fluctuation amount ΔT30[3] by the rotation fluctuation amount ΔT30[2] is less than or equal to the determination value Rth.

Condition (E): The value obtained by dividing the rotation fluctuation amount ΔT30[0] by the rotation fluctuation amount ΔT30[2] is less than or equal to the determination value Rth.

This process of S72 is executed to determine whether the rotation fluctuation amount ΔT30[2] of cylinder #2 is extremely larger than the rotation fluctuation amounts ΔT30[0] and ΔT30[3] that are chronologically prior to and subsequent to the rotation fluctuation amount ΔT30[2] in the cylinders in which combustion control is executed.

Section (c) of FIG. 6 shows changes in the rotation fluctuation amount ΔT30 in a case where a misfire has occurred in cylinder #2. As shown in section (c) of FIG. 6, the rotation fluctuation amount ΔT30[1] of cylinder #1 in which combustion control is intentionally deactivated and the rotation fluctuation amount ΔT30[2] of cylinder #2 in which a misfire has occurred are negative. The rotation fluctuation amounts ΔT30[3] and ΔT30[0] of cylinders #4 and #3 in which combustion control is continued and a misfire has not occurred are positive. Thus, in the example shown in section (c) of FIG. 6, the conditions (D) and (E) are both satisfied.

Referring back to FIG. 4, when determining that the logical conjunction of S72 is true (S72: YES), the CPU 72 determines that a misfire has occurred in cylinder #2 (S74).

When completing the process of S64, S70, S74 or when making a negative determination in the process of S62, S68, S72, the CPU 72 temporarily ends the process of S42 shown in FIG. 3.

The operation and advantages of the present embodiment will now be described.

When the deposition amount DPM becomes greater than or equal to the threshold value DPMth, the CPU 72 executes the regenerating process for the GPF 34. This allows the air drawn in the intake stroke of cylinder #1 to flow out to the exhaust passage 30 in the exhaust stroke of cylinder #1 without being burned. The air-fuel mixture of cylinders #2 to #4 is set to be richer than the stoichiometric air-fuel ratio. Thus, the exhaust gas discharged from cylinders #2 to #4 to the exhaust passage 30 includes a vast amount of unburned fuel. The oxygen and unburned fuel discharged to the exhaust passage 30 increase the temperature of the GPF 34 by being burned in the three-way catalyst 32 or the like. The oxygen in the air that has flowed to the exhaust passage 30 oxidizes PM in the GPF 34. This burns and removes the PM.

In the case of executing the regenerating process, the CPU 72 determines that a misfire has occurred when the divergence degree is large between the rotation fluctuation amount ΔT30 of the determined cylinder and the rotation fluctuation amounts ΔT30 of cylinders in which combustion control is executed and which are chronologically prior to and subsequent to the determined cylinder. Thus, in the present embodiment, when cylinder #1 is the cylinder having the occurrence point in time of the compression top dead center that is adjacent to the occurrence point in time of the compression top dead center of the determined cylinder, the determination of the divergence degree from the rotation fluctuation amount ΔT30 of cylinder #1 is not executed. That is, in the present embodiment, ΔT30[2] in section (b) of FIG. 6 and ΔT30[1] in section (c) of FIG. 6 are the rotation fluctuation amounts ΔT30 of cylinder #1 and thus are not used for the determination of the divergence degree. This prevents an erroneous determination that no misfire has occurred although a misfire has occurred.

More specifically, for example, when a misfire is determined as having occurred in a case where the divergence degree is large between the rotation fluctuation amount ΔT30[1] of the determined cylinder #3 in section (b) of FIG. 6 and a pair of rotation fluctuation amounts ΔT30[0] and ΔT30[2], which are chronologically prior to and subsequent to the determined cylinder, an erroneous determination that no misfire has occurred is made. The present embodiment prevents such an erroneous determination.

The above-described present embodiment further provides the following operation and advantages.

(1) The CPU 72 determines whether a misfire has occurred by comparing the magnitude of the determination value Rth with the magnitude of the ratio of the rotation fluctuation amount ΔT30 of the determined cylinder, which is a cylinder subject to the determination of whether a misfire has occurred, to a rotation fluctuation amount ΔT30 subject to comparison. The magnitude of the rotation fluctuation amount ΔT30 varies in correspondence with the rotation speed NE of the internal combustion engine 10 and load on the internal combustion engine 10. Thus, for example, when the divergence degree is defined from the difference between the rotation fluctuation amount ΔT30 of the determined cylinder and the rotation fluctuation amount ΔT30 subject to comparison, the magnitude of the determination value suitable for determining whether a misfire has occurred fluctuates in correspondence with the rotation speed NE and the load. As compared with the magnitude of the rotation fluctuation amount ΔT30, the pair of rotation fluctuation amounts ΔT30 varies to a small extent in correspondence with the rotation speed NE and the load. Thus, in the present embodiment, the ratio of the pair of rotation fluctuation amounts ΔT30 is used instead of the difference between the pair of rotation fluctuation amounts ΔT30. This allows the determination value Rth to be a fixed value while maintaining the high accuracy of determining whether a misfire has occurred.

(2) The CPU 72 determines that a misfire has occurred when the divergence degree is large between the rotation fluctuation amount ΔT30 of the determined cylinder and the pair of rotation fluctuation amounts ΔT30 of the cylinders in which combustion control is executed and which are chronologically prior to and subsequent to the determined cylinder. Thus, as compared with when, for example, there is one cylinder of which the divergence degree from the rotation fluctuation amount ΔT30 of the determined cylinder is compared, it is determined whether a misfire has occurred with higher accuracy.

Second Embodiment

A second embodiment will now be described with reference to FIGS. 7 and 8. The differences from the first embodiment will mainly be described.

In the present embodiment, the combustion variable used to detect a misfire is quantified using the in-cylinder pressure Pc instead of the rotation fluctuation amount ΔT30.

Figure 7:
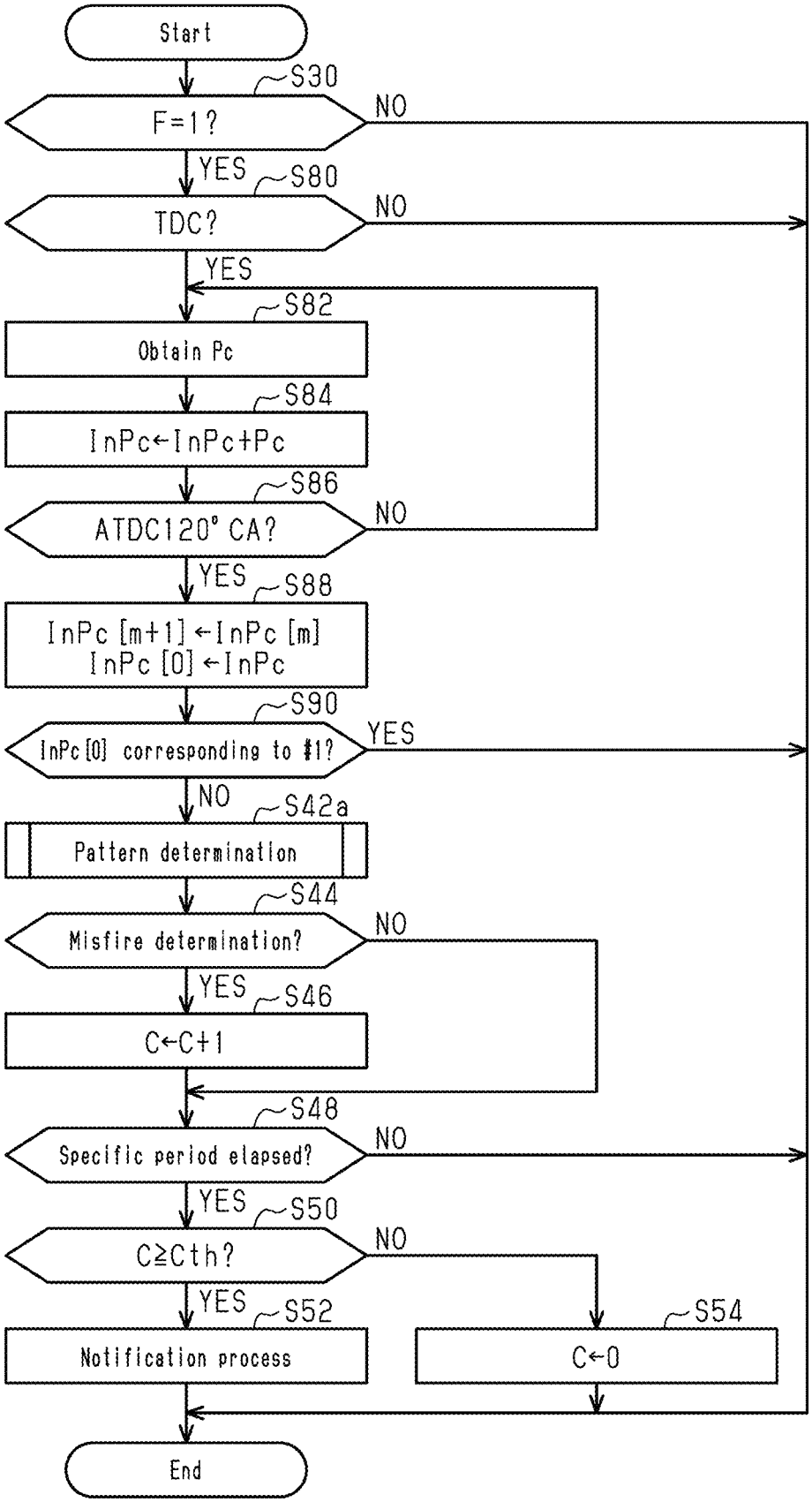
FIG. 7 is a flowchart showing a procedure for processes executed by the controller according to a second embodiment.

FIG. 7 shows a procedure for processes related to determining whether a misfire has occurred in the present embodiment. The processes shown in FIG. 7 are executed by the CPU 72 repeatedly executing programs stored in the ROM 74, for example, in a specific cycle. In FIG. 7, the same step numbers are given to the processes that correspond to those in FIG. 3.

In the series of processes shown in FIG. 7, when first determining that the flag F is 1 (S30: YES), the CPU 72 determines whether the current rotation angle of the crankshaft 26 is the compression top dead center of one of cylinders #1 to #4 or not (S80). When determining that the current rotation angle of the crankshaft 26 is the compression top dead center of one of cylinders #1 to #4 (S80: YES), the CPU 72 obtains the in-cylinder pressure Pc (S82). The CPU 72 updates an in-cylinder pressure integration value InPc by using a value obtained by adding the in-cylinder pressure Pc to the in-cylinder pressure integration value InPc (S84). The CPU 72 continues the processes of S82, S84 over the angular interval of 120° CA (S86: NO).

When determining that the current rotation angle of the crankshaft 26 is ATDC120° CA (S86: YES), the CPU 72 substitutes an in-cylinder pressure integration value InPc[m] into an in-cylinder pressure integration value InPc[m+1] and substitutes the currently-calculated in-cylinder pressure integration value InPc into an in-cylinder pressure integration value InPc[0] (S88). Next, the CPU 72 determines whether the in-cylinder pressure integration value InPc[0] is the amount of cylinder #1 (S90). When determining in the process of S86 that the current rotation angle of the crankshaft 26 is the current rotation angle of the crankshaft 26 that has passed by 120° CA from the compression top dead center of cylinder #1, the CPU 72 determines that the in-cylinder pressure integration value InPc[0] is the amount of cylinder #1 (S90: YES). When determining that the in-cylinder pressure integration value InPc[0] is not the amount of cylinder #1 (S90: NO), the CPU 72 uses the in-cylinder pressure integration value InPc to execute a pattern determination of whether a misfire has occurred (S42*a*). Then, the CPU 72 executes the processes from S44 to SM.

When completing the process of S52, SM, when making a negative determination in the process of S30, S80, S48, or when making an affirmative determination in the process of S90, the CPU 72 temporarily ends the series of processes shown in FIG. 7.

Figure 8:
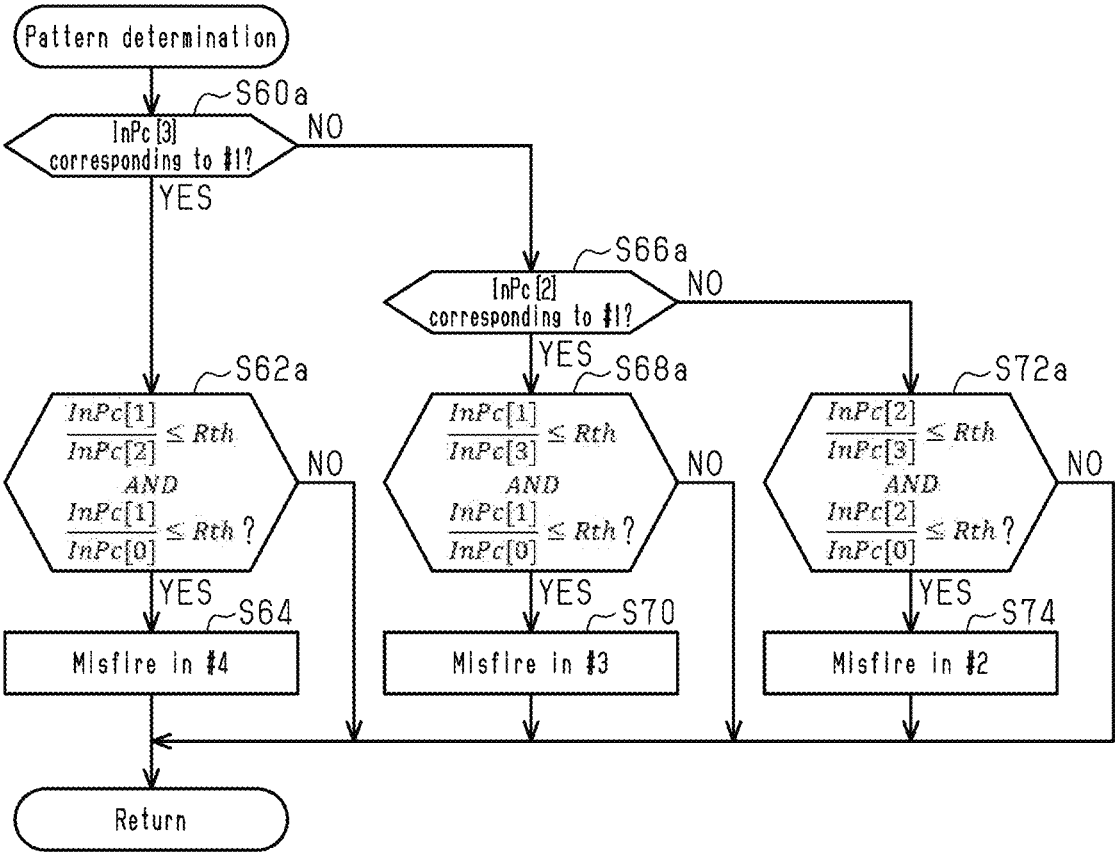
FIG. 8 is a flowchart illustrating a procedure for processes executed by the controller in the embodiment of FIG. 7.

FIG. 8 shows the details of the process of S42*a*. In FIG. 8, the same step numbers are given to the processes that correspond to those in FIG. 4.

In the series of processes shown in FIG. 8, the CPU 72 first determines whether the in-cylinder pressure integration value InPc[3] relates to cylinder #1 (S60*a*). When determining that the in-cylinder pressure integration value InPc[3] relates to cylinder #1 (S60*a*: YES), the CPU 72 determines whether the logical conjunction of the following conditions (F) and (G) is true (S62*a*).

Condition (F): The value obtained by dividing the in-cylinder pressure integration value InPc[1] by the in-cylinder pressure integration value InPc[2] is less than or equal to the determination value Rth.

Condition (G): The value obtained by dividing the in-cylinder pressure integration value InPc[1] by the in-cylinder pressure integration value InPc[0] is less than or equal to the determination value Rth.

This process of S62*a* is executed to determine whether the in-cylinder pressure integration value InPc[1] of cylinder #4 is extremely smaller than the in-cylinder pressure integration values InPc[0] and InPc[2] that are chronologically prior to and subsequent to the in-cylinder pressure integration value InPc[1].

When determining that the logical conjunction of the conditions (F) and (G) is true (S62*a*: YES), the CPU 72 determines that a misfire has occurred in cylinder #4 (S64). That is, the in-cylinder pressure Pc is smaller and thus the in-cylinder pressure integration value InPc is smaller when a misfire has occurred in cylinder #4 than when a misfire has not occurred in cylinder #4. Thus, when a misfire has occurred in cylinder #4, the above-described conditions (F) and (G) are satisfied.

When making a negative determination in the process of S60*a*, the CPU 72 determines whether the in-cylinder pressure integration value InPc[2] relates to cylinder #1 (S66*a*). This process is executed to determine whether it is appropriate to use the above-described condition (F) for a determination of whether an anomaly has occurred. When determining that the in-cylinder pressure integration value InPc [2] relates to cylinder #1 (S66*a*: YES), the CPU 72 determines whether the logical conjunction of the following condition (H) and the above-described condition (G) is true (S68*a*).

Condition (H): The value obtained by dividing the in-cylinder pressure integration value InPc[1] by the in-cylinder pressure integration value InPc[3] is less than or equal to the determination value Rth.

This process of S68*a* is executed to determine whether the in-cylinder pressure integration value InPc[1] of cylinder #3 is extremely smaller than the in-cylinder pressure integration values InPc[0] and InPc[3] that are chronologically prior to and subsequent to the in-cylinder pressure integration value InPc[1] in the cylinders in which combustion control is executed.

When determining that the logical conjunction of the conditions (H) and (G) is true (S68*a*: YES), the CPU 72 determines that a misfire has occurred in cylinder #3 (S70).

When determining that the in-cylinder pressure integration value InPc[1] relates to cylinder #1 (S66*a*: NO), the CPU 72 determines whether the logical conjunction of the following conditions (I) and (J) is true (S72*a*).

Condition (I): The value obtained by dividing the in-cylinder pressure integration value InPc[2] by the in-cylinder pressure integration value InPc[3] is less than or equal to the determination value Rth.

Condition (J): The value obtained by dividing the in-cylinder pressure integration value InPc[2] by the in-cylinder pressure integration value InPc[0] is less than or equal to the determination value Rth.

This process of S72*a* is executed to determine whether the in-cylinder pressure integration value InPc[2] of cylinder #2 is extremely smaller than the in-cylinder pressure integration values InPc[0] and InPc[3] that are chronologically prior to and subsequent to the in-cylinder pressure integration value InPc[2] in the cylinders in which combustion control is executed.

When determining that the logical conjunction of the conditions (I) and (J) is true (S72*a*: YES), the CPU 72 determines that a misfire has occurred in cylinder #2 (S74).

When completing the process of S64, S70, S74 or when making a negative determination in the process of S62*a*, S68*a*, S72*a*, the CPU 72 temporarily ends the process of S42*a* shown in FIG. 7.

Correspondence

The correspondence between the items in the above-described embodiments and the items described in the above-described SUMMARY is as follows. In the following description, the correspondence is shown for each of the numbers in the examples described in the SUMMARY.

[1] The deactivating process corresponds to the process of S22.

The combustion variable obtaining process corresponds to the process of S38 in FIG. 3 and the process of S84 in FIG. 7.

The determining process corresponds to the processes of S42, S42*a*.

[2] The comparison rotation fluctuation amount corresponds to the rotation fluctuation amount ΔT30.

The instantaneous speed variable corresponds to the time T30.

[3] The process of this aspect corresponds to the processes of S62, S68, S72.

[4] The cylinder different from the determined cylinder and adjacent to the deactivated cylinder corresponds to cylinder #2 in section (b) of FIG. 6 and cylinder #3 in section (c) of FIG. 6.

The closer cylinder in which combustion control is executed corresponds to cylinder #4 in section (b) of FIG. 6 and cylinder #4 in section (c) of FIG. 6. The closer cylinder, which is closer to the determined cylinder, corresponds to cylinder #4 in section (b) of FIG. 6 and cylinder #4 in section (c) of FIG. 6.

The deactivated cylinder corresponds to cylinder #1. That is, the CPU causes the combustion control in cylinder #1 to be deactivated.

The determined cylinder corresponds to cylinder #3 in section (b) of FIG. 6 and cylinder #2 in section (c) of FIG. 6.

[5, 6] The sensor corresponds to the in-cylinder pressure sensor 89.

The combustion variable corresponds to the in-cylinder pressure integration value InPc.

Modifications

The present embodiment may be modified as follows. The above-described embodiment and the following modifications can be combined as long as the combined modifications remain technically consistent with each other.

Modification Related to Rotation Fluctuation Amount

The rotation fluctuation amount ΔT30 does not have to be a value obtained by subtracting, from the time T30 required for the rotation of a section between TDC and 30ATDC of a cylinder that reaches its compression top dead center immediately subsequent to the determined cylinder, the time T30 required for the rotation of a section between TDC and 30ATDC of the determined cylinder. For example, the rotation fluctuation amount ΔT30 may be set to a value obtained by subtracting, from the time T30 required for the rotation of a section between 90TDC and 120ATDC of the determined cylinder, the time T30 required for the rotation of the section between TDC and 30ATDC of the determined cylinder.

In the above-described embodiments, the rotation fluctuation amount, which is the fluctuation amount of the rotation speed of the crankshaft 26 in the rotation angle interval that is less than or equal to the occurrence interval of a compression top dead center, is quantified using the difference between the times required for the rotation of the rotation angle interval. Instead, the rotation fluctuation amount may be quantified using a ratio.

The instantaneous speed variable, which indicates the rotation speed of the crankshaft 26 in the rotation angle interval that is less than or equal to the occurrence interval of a compression top dead center used to define the rotation fluctuation amount, does not have to indicate the rotation speed of the crankshaft 26 in a section of 30° CA. For example, the instantaneous speed variable may indicate the rotation speed of the crankshaft 26 in a section of 180° CA.

In the above-described embodiments, the instantaneous speed variable, which indicates the rotation speed of the crankshaft 26 in the rotation angle interval that is less than or equal to the occurrence interval of a compression top dead center used to define the rotation fluctuation amount, is quantified using the time required for the rotation of the rotation angle interval. Instead, the rotation fluctuation amount may be quantified using a speed.

Modification Related to Conditions for Executing Regenerating Process

The conditions for executing the regenerating process do not necessarily have to include the above-described conditions (a) and (b). For example, only one of the two conditions (a) and (b) may be included. Alternatively, the two conditions (a) and (b) may be both omitted.

Modification Related to Sensor that is Located in Combustion Chamber and Detects Combustion State In the above-described embodiments, the sensor that detects the combustion state is the in-cylinder pressure sensor. Instead, for example, a sensor that detects ion currents may be used.

Modification Related to Combustion Variable

The combustion variable calculated by using the output signal Scr of the crank angle sensor 82 as an input is not limited to the rotation fluctuation amount. For example, the combustion variable may be the average value of the axial torque of the internal combustion engine 10 in a specific period. This is calculated using the following equation (c1).

$$Te = Ie \cdot d\omega e + (1+\rho)/\{\rho \cdot (Ig1 \cdot d\omega m1 - Tr)\} \quad \text{(c1)}$$

This equation includes the axial torque Te, the change speed dωe of the instantaneous speed we of the internal combustion engine 10 calculated from the reciprocal of the time T30 or the like, the moment of inertia Ie of the internal combustion engine 10, the moment of inertia Ig1 of the first motor generator 52, the angular acceleration dωm1 of the first motor generator 52, the reaction torque Tr of the first motor generator 52, and the planetary gear ratio ρ of the planetary gear mechanism 50. The above-described specific period is set to be less than or equal to the occurrence interval of a compression top dead center.

In the processes of FIGS. 7 and 8, the in-cylinder pressure integration value InPc is used as the combustion variable defined in correspondence with the detection value of the in-cylinder pressure sensor 89. Instead, for example, the combustion variable may be a combustion energy amount or the maximum value of the in-cylinder pressure Pc.

In the case of using an ion current sensor as the sensor as described in the section of Modification Related to Sensor that is Located in Combustion Chamber and Detects Combustion State, the combustion variable may include, for example, the integration value of ion current.

Modification Related to Determining Process

The pattern determination based on the rotation fluctuation amount is not limited to the determination of whether a misfire has occurred from the following two divergence degrees of the determined cylinder from the rotation fluctuation amount. The two divergence degrees are the divergence degrees between the rotation fluctuation amount of the determined cylinder and the rotation fluctuation amounts of cylinders which have compression top dead centers chronologically prior to and subsequent to the compression top dead center of the determined cylinder, in which combustion control is executed, and which are proximate to the determined cylinder. Instead, for example, one divergence degree may be used to determine whether a misfire has occurred. That is, whether a misfire has occurred may be determined only using the divergence degree between the rotation fluctuation amount of the determined cylinder and the rotation fluctuation amount of the cylinder which has a compression top dead center on the advanced side of the compression top dead center of the determined cylinder, in which combustion control is executed, and which is proximate to the determined cylinder. Even in this case, when combustion control is deactivated in the cylinder that is on the advanced side of the determined cylinder and is proximate to the determined cylinder, the rotation fluctuation amount of the determined cylinder can be compared with the rotation fluctuation amount of the cylinder that is immediately prior to the cylinder in which combustion control is deactivated. Further, the number of the rotation fluctuation amounts compared with the rotation fluctuation amount of the determined cylinder does not necessarily have to be one or two. For example, three or more rotation fluctuation amounts may be compared with the rotation fluctuation amount of the determined cylinder.

In the above-described embodiments, the magnitude of the determination value Rth compared with the magnitude of the ratio of rotation fluctuation amounts is the fixed value. Instead, for example, the determination value may be variably set in correspondence with at least one of two variables, namely, the variable indicating load on the internal combustion engine and the rotation speed NE.

The divergence degree between the rotation fluctuation amount of the determined cylinder and a rotation fluctuation amount subject to comparison does not necessarily have to be quantified using the ratio of a pair of rotation fluctuation amounts. Instead, for example, the divergence degree may be quantified using the difference between the rotation fluctuation amount of the determined cylinder and the rotation fluctuation amount subject to comparison. In this case, it is desired that the magnitude of the determination value compared with the magnitude of the difference of the rotation fluctuation amount be variably set in correspondence with at least one of two variables, namely, the variable indicating load on the internal combustion engine and the rotation speed NE.

In the processes of FIGS. 3 and 4, to facilitate understanding, only the pattern determination of S42 is used to determine whether a misfire has occurred. Instead, for example, regarding the rotation fluctuation amount ΔT30[0] of the determined cylinder, it may be finally determined that a misfire has occurred when the logical conjunction is true of the process of S44 and the determination that a misfire has occurred when ΔT30[0]-ΔT30[2] is greater than or equal to the determination value Δth. Thus, a first advantage is provided. This prevents an erroneous determination that a misfire has occurred when an affirmative determination is made in the process of S44 although no misfire has occurred. Such an erroneous determination is made in a case where, for example, each rotation fluctuation amount ΔT30 is approximately zero because combustion is normal in all the cylinders when the flag F is 0. In addition, a second advantage is provided. This allows for the determination of whether a misfire has occurred while preventing the influence of, for example, the tolerance of the crank rotor 40, and also prevents the accuracy of the misfire determination from being lowered by, for example, a disturbance from the road surface. That is, the rotation fluctuation amount ΔT30[0] and the rotation fluctuation amount ΔT30[2] are calculated in reference to the same tooth 42. Thus, even when the interval between adjacent ones of the teeth 42 has a tolerance, the influence of the tolerance on a pair of rotation fluctuation amounts ΔT30 (rotation fluctuation amount ΔT30[0] and rotation fluctuation amount ΔT30[2]) is the same. Thus, ΔT30[0]-ΔT30[2] is unaffected by the tolerance. Accordingly, comparing the magnitude of ΔT30[0]-ΔT30[2] with the magnitude of the determination value Δth is desirable for determining whether a misfire has occurred while preventing the influence of the tolerance. However, even when, for example, the value of the rotation fluctuation amount ΔT30 is gradually decreased in the order of ΔT30[2], ΔT30[1], and ΔT30[0] by the influence of a disturbance of the road surface or the like and ΔT30[0]-ΔT30[2] is greater than or equal to the determination value Δth although no misfire has occurred in the determined cylinder, the pattern determination of S42 determines that no misfire has occurred.

It is desired that the determination value Δth be variably set in correspondence with at least one of two variables, namely, the variable indicating load on the internal combustion engine and the rotation speed NE. Further, ΔT30[0] may be compared with the rotation fluctuation amount ΔT30[4] instead of the rotation fluctuation amount ΔT30[2].

The pattern determination using the in-cylinder pressure integration value InPc is not limited to the determination of whether a misfire has occurred from two divergence degrees. That is, the divergence degrees are not limited to the divergence degrees between the in-cylinder pressure integration value InPc of the determined cylinder and the in-cylinder pressure integration values InPc of cylinders which have compression top dead centers chronologically prior to and subsequent to the compression top dead center of the determined cylinder, in which combustion control is executed, and which are proximate to the determined cylinder. Instead, the pattern determination may use one divergence degree to determine whether a misfire has occurred. For example, whether a misfire has occurred may be determined only using the divergence degree between the in-cylinder pressure integration value InPc of the determined cylinder and the in-cylinder pressure integration value InPc of the cylinder which has a compression top dead center on the advanced side of the compression top dead center of the determined cylinder, in which combustion control is executed, and which is proximate to the determined cylinder. Even in this case, when combustion control is deactivated in the cylinder that is on the advanced side of the determined cylinder and is proximate to the determined cylinder, the determined cylinder can be compared with the in-cylinder pressure integration value InPc of the cylinder that is immediately prior to the cylinder in which combustion control is deactivated. Further, the number of the in-cylinder pressure integration values InPc subject to comparison does not necessarily have to be one or two. Alternatively, for example, three or more in-cylinder pressure integration values InPc may be used for comparison.

In the above-described embodiments, the magnitude of the determination value Rth compared with the magnitude of the ratio of a pair of in-cylinder pressure integration values InPc is a fixed value. Instead, for example, the determination value may be variably set in correspondence with at least one of two variables, namely, the variable indicating load on the internal combustion engine and the rotation speed NE.

The divergence degree between the in-cylinder pressure integration value InPc of the determined cylinder and the in-cylinder pressure integration value InPc subject to comparison does not necessarily have to be quantified using the ratio of a pair of in-cylinder pressure integration values InPc. Instead, for example, the divergence degree may be quantified using the difference between the pair of in-cylinder pressure integration values InPc. In this case, it is desired that the magnitude of the determination value compared with the magnitude of the difference between the pair of in-cylinder pressure integration values InPc be variably set in correspondence with at least one of the two variables, namely, the variable indicating load on the internal combustion engine and the rotation speed NE.

Modification Related to Regenerating Process

The number of cylinders in which combustion control is deactivated is not limited to one. Further, the cylinder in which combustion control is deactivated does not necessarily have to be fixed to a predefined cylinder. For example, the cylinder in which combustion control is deactivated may be changed in each combustion cycle. Even in this case, the procedure described with reference to FIG. 6 can be used to determine whether a misfire has occurred.

Modification Related to Deactivating Process

The deactivating process for combustion control is not limited to the regenerating process. For example, the deactivation process may be a process that deactivates the supply of fuel in a specified cylinder in order to adjust the output of the internal combustion engine 10. Instead, in a case where an anomaly has occurred in a specified cylinder, the deactivating process may be performed to deactivate combustion control in the cylinder where the anomaly occurs. Alternatively, when the oxygen absorption amount of the three-way catalyst 32 is less than or equal to a given value, the deactivating process may be performed to deactivate combustion control only in a specified cylinder in order to supply oxygen to the three-way catalyst 32 and execute control that sets the air-fuel ratio of air-fuel mixture in the remaining cylinders to the stoichiometric air-fuel ratio.

Modification Related to Reflection of Determination Result of Misfire

In the above-described embodiments, when misfire has been determined as having occurred, the notification process using the warning light 100 is executed. However, the notification process is not limited to the process in which a device that outputs visual information is subject to operation, and may be, for example, a process in which a device that outputs auditory information is subject to operation.

The determination result of misfire does not necessarily have to be used for the notification process. For example, in a case where a misfire has occurred, a process may be executed to operate the operation units of the internal combustion engine 10 such that the control of the internal combustion engine 10 is changed to an operating state in which a misfire does not easily occur. That is, the hardware means subject to the operation in order to handle the misfire determination result is not limited to a notification device and may be, for example, an operation unit of the internal combustion engine 10

Modification Related to Estimation of Deposition Amount

The process that estimates the deposition amount DPM is not limited to the one illustrated in FIG. 2. Instead, for example, the deposition amount DPM may be estimated using the intake air amount Ga and the pressure difference between the upstream side and the downstream side of the GPF 34. More specifically, the deposition amount DPM is estimated to be a larger value when the pressure difference is large than when the pressure difference is small Even when the pressure difference is the same, the deposition amount DPM simply needs to be estimated to be a larger value when the intake air amount Ga is small than when the intake air amount Ga is large. If the pressure in the downstream side of the GPF 34 is regarded as a fixed value, the pressure Pex may be used for the process that estimates the deposition amount DPM, instead of the pressure difference.

Modification Related to Aftertreatment Device

The GPF 34 is not limited to the filter supported by the three-way catalyst and may be only the filter. Further, the GPF 34 does not have to be located on the downstream side of the three-way catalyst 32 in the exhaust passage 30. Furthermore, the aftertreatment device does not necessarily have to include the GPF 34. For example, even when the aftertreatment device includes only the three-way catalyst 32, the processes illustrated in the above-described embodiment and the modifications can be executed as the misfire detecting process when combustion control is deactivated in a specified cylinder to supply oxygen to the three-way catalyst 32.

Modification Related to Controller

The controller is not limited to a device that includes the CPU 72 and the ROM 74 and executes software processing. For example, at least part of the processes executed by the software in the above-described embodiments may be executed by hardware circuits dedicated to executing these processes (such as ASIC). That is, the control device may be modified as long as it has any one of the following configurations (a) to (c): (a) a configuration including a processor that executes all of the above-described processes according to programs and a program storage device such as a ROM (including a non-transitory computer readable memory medium) that stores the programs. (b) a configuration including a processor and a program storage device that execute part of the above-described processes according to the programs and a dedicated hardware circuit that executes the remaining processes; and (c) a configuration including a dedicated hardware circuit that executes all of the above-described processes. A plurality of software execution devices each including a processor and a program storage device and a plurality of dedicated hardware circuits may be provided.

Modification Related to Vehicle

The vehicle is not limited to a series-parallel hybrid vehicle and may be, for example, a parallel hybrid vehicle or a series-parallel hybrid vehicle. The hybrid vehicle may be replaced with, for example, a vehicle in which only the internal combustion engine 10 is used as a power generation device for the vehicle.

In this specification, "at least one of A and B" should be understood to mean "only A, only B, or both A and B."

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A misfire detection device for an internal combustion engine, the misfire detection device being employed in the internal combustion engine including cylinders, the misfire detection device comprising:

misfire detection circuitry configured to execute:

a deactivating process that deactivates combustion control for air-fuel mixture in a deactivated cylinder serving as a specified one of the cylinders;

a combustion variable obtaining process that obtains a value of a combustion variable, the combustion variable indicating a combustion state in each of the cylinders, a sensor detecting a physical quantity corresponding to the combustion state of the air-fuel mixture in each of the cylinders, the combustion variable being defined by a detection value of the sensor;

a determining process that determines whether a misfire has occurred in a determined cylinder serving as a cylinder subject to a determination of whether the misfire has occurred on condition that a divergence degree is greater than or equal to a specific amount during the execution of the deactivating process, an occurrence point in time of each of compression top dead centers of cylinders adjacent to the deactivated cylinder being adjacent to an occurrence point in time of a compression top dead center of the deactivated cylinder, the cylinders adjacent to the deactivated cylinder including the determined cylinder and a cylinder different from the determined cylinder and adjacent to the deactivated cylinder, the divergence degree being between the value of the combustion variable of the cylinder different from the determined cylinder and adjacent to the deactivated cylinder and the value of the combustion variable of the determined cylinder; and controlling predetermined hardware based on a determination result of whether the misfire has occurred in the determined cylinder, and wherein the cylinders adjacent to the deactivated cylinder and the cylinder different from the determined cylinder and adjacent to the deactivated cylinder are cylinders in which the combustion control has been executed.

2. The misfire detection device according to claim 1, wherein the sensor includes a crank angle sensor, the combustion variable is a rotation fluctuation amount of a crankshaft of the internal combustion engine, the rotation fluctuation amount relates to a difference between magnitudes of instantaneous speed variables, each of the instantaneous speed variables indicates a rotation speed of the crankshaft in a specific angle interval that is less than or equal to an occurrence interval of a compression top dead center of the internal combustion engine, and the instantaneous speed variables of the rotation fluctuation amount of a certain cylinder of the cylinders include the instantaneous speed variable in a period between a compression top dead center of the certain cylinder and a compression top dead center subsequent to the compression top dead center of the certain cylinder.

3. The misfire detection device according to claim 2, wherein the determining process includes a process that determines whether the misfire has occurred by comparing a magnitude of a determination threshold value with a magnitude of a ratio of the rotation fluctuation amount of the cylinder different from the determined cylinder and adjacent to the deactivated cylinder to the rotation fluctuation amount of the determined cylinder.

4. The misfire detection device according to claim 2, wherein the deactivated cylinder is one cylinder, the determining process includes a process that determines whether the misfire has occurred in the determined cylinder on condition that a divergence degree between the rotation fluctuation amount of the cylinder different from the determined cylinder and adjacent to the deactivated cylinder and the rotation fluctuation amount of the determined cylinder is greater than or equal to a specific amount and a divergence degree between the rotation fluctuation amount of a closer cylinder and the rotation fluctuation amount of the determined cylinder is greater than or equal to a specific amount, an occurrence point in time of a compression top dead center of the closer cylinder is closer to an occurrence point in time of the compression top dead center of the determined cylinder than an interval between an occurrence point in time of a compression top dead center of the cylinder different from the determined cylinder and adjacent to the deactivated cylinder and the occurrence point in time of the compression top dead center of the determined cylinder, and the closer cylinder is a cylinder in which the combustion control is executed.

5. The misfire detection device according to claim 1, wherein the sensor is provided in a combustion chamber of each of the cylinders and is configured to detect the combustion state of the air-fuel mixture in the combustion chamber, and the combustion variable of each of the cylinders is quantified using the detection value of the sensor during a compression top dead center of the cylinder and a compression top dead center that occurs subsequently.

6. The misfire detection device according to claim 5, wherein the sensor is configured to detect pressure in the combustion chamber.

7. A misfire detection method for an internal combustion engine, the misfire detection method being employed in the internal combustion engine including cylinders, the misfire detection method comprising:

deactivating, by misfire detection circuitry, combustion control for air-fuel mixture in a deactivated cylinder serving as a specified one of the cylinders;

obtaining, by the misfire detection circuitry, a value of a combustion variable, the combustion variable indicating a combustion state in each of the cylinders, a sensor detecting a physical quantity corresponding to the combustion state of the air-fuel mixture in each of the cylinders, the combustion variable being defined by a detection value of the sensor;

determining, by the misfire detection circuitry, whether a misfire has occurred in a determined cylinder serving as a cylinder subject to a determination of whether the misfire has occurred on condition that a divergence degree is greater than or equal to a specific amount during the execution of the deactivating combustion control, an occurrence point in time of each of compression top dead centers of cylinders adjacent to the deactivated cylinder being adjacent to an occurrence point in time of a compression top dead center of the deactivated cylinder, the cylinders adjacent to the deactivated cylinder including the determined cylinder and a cylinder different from the determined cylinder and adjacent to the deactivated cylinder, the divergence degree being between the value of the combustion variable of the cylinder different from the determined cylinder and adjacent to the deactivated cylinder and the value of the combustion variable of the determined cylinder; and controlling, by the misfire detection circuitry, predetermined hardware based on a determination result of whether the misfire has occurred in the determined cylinder, wherein the cylinders adjacent to the deactivated cylinder and the cylinder different from the determined cylinder and adjacent to the deactivated cylinder are cylinders in which the combustion control has been executed.

8. A non-transitory computer-readable memory medium that stores a program for causing a processor to execute a misfire detection process for an internal combustion engine, the misfire detection process being employed in the internal combustion engine including cylinders, wherein the misfire detection process includes:

deactivating, by misfire detection circuitry, combustion control for air-fuel mixture in a deactivated cylinder serving as a specified one of the cylinders;

obtaining, by the misfire detection circuitry, a value of a combustion variable, the combustion variable indicating a combustion state in each of the cylinders, a sensor detecting a physical quantity corresponding to the combustion state of the air-fuel mixture in each of the cylinders, the combustion variable being defined by a detection value of the sensor;

determining, by the misfire detection circuitry, whether a misfire has occurred in a determined cylinder serving as a cylinder subject to a determination of whether the misfire has occurred on condition that a divergence degree is greater than or equal to a specific amount during the execution of the deactivating combustion control, an occurrence point in time of each of compression top dead centers of cylinders adjacent to the deactivated cylinder being adjacent to an occurrence point in time of a compression top dead center of the deactivated cylinder, the cylinders adjacent to the deactivated cylinder including the determined cylinder and a cylinder different from the determined cylinder and adjacent to the deactivated cylinder, the divergence degree being between the value of the combustion variable of the cylinder different from the determined cylinder and adjacent to the deactivated cylinder and the value of the combustion variable of the determined cylinder; and controlling, by the misfire detection circuitry, predetermined hardware based on a determination result of whether the misfire has occurred in the determined cylinder, wherein the cylinders adjacent to the deactivated cylinder and the cylinder different from the determined cylinder and adjacent to the deactivated cylinder are cylinders in which the combustion control has been executed.

* * * * *